United States Patent [19]

Bako

[11] 4,350,375

[45] Sep. 21, 1982

[54] DOUBLE-SLIDER ZIPPER LATCHING DEVICE

[75] Inventor: Lazlo Bako, Woodcliff Lake, N.J.

[73] Assignee: Presto Lock, Inc., Garfield, N.J.

[21] Appl. No.: 119,977

[22] Filed: Feb. 8, 1980

[51] Int. Cl.[3] ..... A44B 19/00

[52] U.S. Cl. ..... 292/24; 24/205 R; 70/68

[58] Field of Search ..... 292/24; 24/205 R; 70/11, 10, 9, 68, 69

[56] References Cited

U.S. PATENT DOCUMENTS

| | | | |
|---|---|---|---|
| 352,206 | 11/1886 | Seed | 70/11 |
| 3,070,986 | 1/1963 | Hart | 70/68 |
| 3,335,586 | 8/1967 | Levine et al. | 70/68 |
| 3,597,945 | 8/1971 | Feinberg | 70/74 |
| 3,858,283 | 1/1975 | Runnels | 24/205 |
| 3,965,706 | 6/1976 | Davis | 70/68 |
| 3,978,697 | 9/1976 | Bako | 70/68 |
| 4,015,457 | 4/1977 | Fukuroi | 24/205 R X |
| 4,015,457 | 4/1977 | Fukuroi | 70/68 |
| 4,112,990 | 9/1978 | Anderson | 150/3 |
| 4,271,689 | 6/1981 | Kasai | 70/68 |

FOREIGN PATENT DOCUMENTS

| | | | |
|---|---|---|---|
| 164614 | 11/1949 | Austria | 70/68 |
| 894401 | 4/1962 | United Kingdom . | |
| 966999 | 8/1964 | United Kingdom . | |
| 1037791 | 8/1966 | United Kingdom . | |
| 1173315 | 12/1969 | United Kingdom . | |
| 1534806 | 12/1978 | United Kingdom . | |
| 1574038 | 9/1980 | United Kingdom . | |

*Primary Examiner*—Richard E. Moore

*Attorney, Agent, or Firm*—Shapiro and Shapiro

[57] ABSTRACT

A latching device for the sliders of a double-slider zipper arrangement comprises a pair of tab assemblies formed for attachment to the pull tabs of the sliders, and a latch assembly mounted on one of the tab assemblies and formed for latching engagement with the other tab assembly. In the latched position, the latching device securely holds the sliders in substantially abutting relationship. The latch assembly may be sized to cover the sliders. A locking mechanism is also included for locking the latching device in a latched position.

23 Claims, 9 Drawing Figures

DOUBLE-SLIDER ZIPPER LATCHING DEVICE

BACKGROUND OF THE INVENTION

This invention relates to improvements in latching devices for zipper sliders, and more particularly to latching devices for a double-slider zipper arrangement such as that used on soft-walled luggage cases.

Luggage cases and similar types of articles which have soft or flexible walls generally employ slide fasteners or zippers as a closure. Frequently, a double-slider zipper is used in which a pair of opposed sliders, movable in opposite directions, come together at some convenient location, such as the center of the zipper, to close the case. To prevent the inadvertent opening of the case, the sliders must be fastened together, preferably in abutting relationship so that there is no gap in the zipper. It is also desirable to employ means for locking the sliders together to provide some measure of security for the contents of the case.

Prior latching (and locking) devices for double-slider zippers have included padlocks passed through holes in the ends of the pull tabs of the sliders. However, this arrangement has had many drawbacks. Padlocks generally do not hold the sliders in abutting relationship. Furthermore, the padlock must be locked to latch the sliders together and must be unlocked to unlatch the sliders. This is a two-handed operation which is cumbersome and undesirable. Other approaches have employed a latching device mounted on the luggage case with which the sliders are brought into engagement. For example, the device may include an upstanding post sized to pass through holes in the slider pull tabs. When the sliders are brought together, the pull tabs are placed over the post and covered by a latching flap or other member to prevent the pull tabs from slipping off. Mounting of such devices is troublesome. Moreover, they are generally bulky and may still permit the sliders to separate slightly, leaving an undesirable gap in the zipper.

SUMMARY OF THE INVENTION

A principal object of the invention is to provide a new and improved zipper slider latching device.

A further object is to provide an improved latching device which will fasten the sliders of a double-slider zipper in abutting relationship with no visible opening in the zipper.

Another object is to provide an improved latching device incorporating a lock for locking the sliders in a latched condition.

An additional object is to provide a latching device capable of being attached quickly and easily to existing sliders, without modification of the sliders, and which can be replaced easily in the event of a malfunction.

A still further object is to provide an improved latching device which is capable of one-handed operation and which has a low profile and an aesthetically pleased appearance.

Briefly stated, a latching device for a double-zipper slider arrangement in accordance with a preferred embodiment of the invention may comprise first and second tab assemblies, each formed for attachment to the pull tab of a zipper slider, and a latch assembly mounted on the first tab assembly and formed for latching engagement with the second tab assembly. More specifically, the latch assembly is pivotally mounted on the first tab assembly for rotation in a plane parallel to the plane of the tab assembly and is sized such that when it is in latching position, the sliders are held in abutting relationship and the latch assembly covers the sliders.

In accordance with another aspect of the invention, an assembly for attachment to the pull tab of a zipper slider comprises a base, a cover positioned on the base to form a case, the case having an opening therein for receiving the pull tab, and a spring member disposed within the case for engaging the pull tab to attach the case thereto.

DETAILED DESCRIPTION OF THE PREFERRED EMBODIMENT

Figure 1:
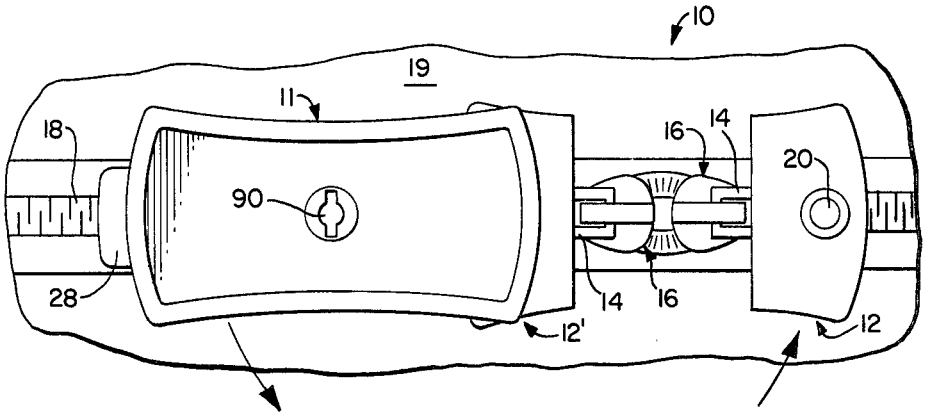
FIGS. 1 and 2 are top plan views illustrating a latching device in accordance with the invention in opened (unlatched) and closed (latched) positions, respectively, the latching device being shown attached to the sliders of a double-slider zipper fixed to a luggage case, partially shown.

The invention is particularly well suited for use with a luggage case having a double-slider zipper or slide fastener as a closure for the case, and will be described in that environment for illustrative purposes. Conventionally, two types of double-slider zipper arrangements may be employed as luggage case closures, and the invention is applicable to both. The first type employs a single continuous slide fastener with fastener elements or scoops of the double-acting type. The second type employs two slide fasteners with single-acting fastener elements, the zippers being arranged with their top stop ends adjacent to one another so that the sliders can be brought together when the zipper is closed. For illustrative purposes, a latching device in accordance with the invention is shown in the drawings employed with a zipper arrangement of the first type.

As illustrated particularly in FIGS. 1–4, a latching device 10 in accordance with the invention generally comprises a latch assembly 11 and a pair of tab assemblies 12, 12', which are preferably identical. As will be described in more detail hereinafter, the tab assemblies are each formed for attachment to the pull tab 14 of a conventional slider 16 of a double-slider zipper 18. The zipper may be secured to opposing walls of a luggage case 19, for example.

Figure 6:
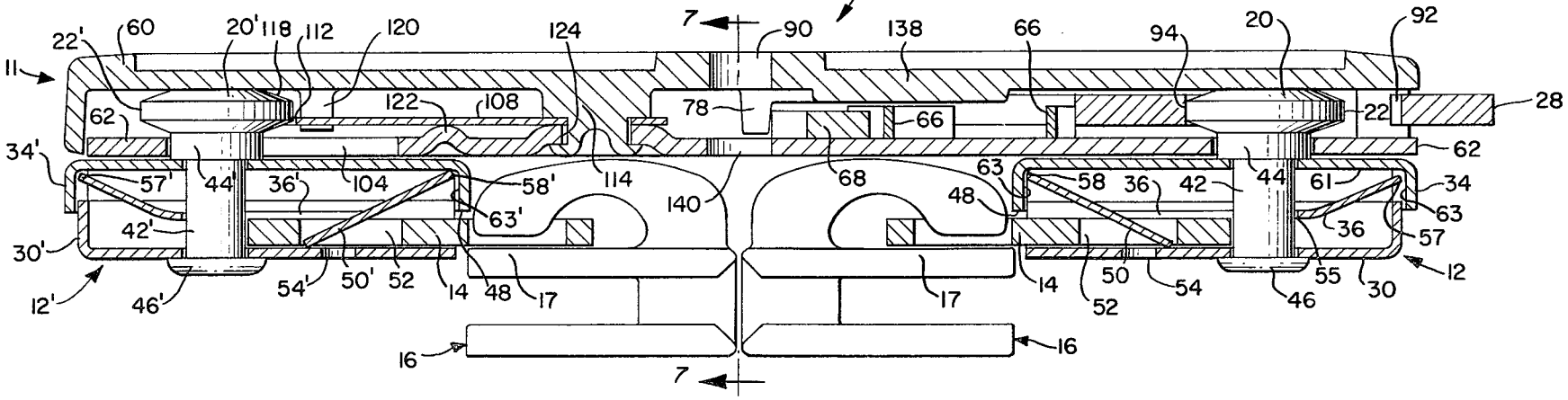
FIG. 6 is an enlarged cross sectional view taken approximately in the direction of line 6—6 of FIG. 5.

As shown particularly in FIG. 6, each assembly 12, 12' includes a projecting stud 20, 20' having a head 22, 22' with a diameter greater than the diameter of the stud. The latch assembly 11 is pivotally mounted for rotation about one end thereof on stud 20' of tab assembly 12' (FIGS. 1, 3 and 4) in a manner to be described. The opposite end of the latch assembly includes an opening 26 (FIG. 3) in one side thereof for receiving head 22 of stud 20 of tab assembly 12, when the sliders are brought together and the latch assembly is rotated about its pivot on stud 20' to latching position (FIGS. 2 and 4). Within the latch assembly is a latch member for latching to stud 20, as will be described later. A push button 28 extends longitudinally from the end of the latch assembly adjacent to opening 26 for unlatching the latching device.

Figure 3:
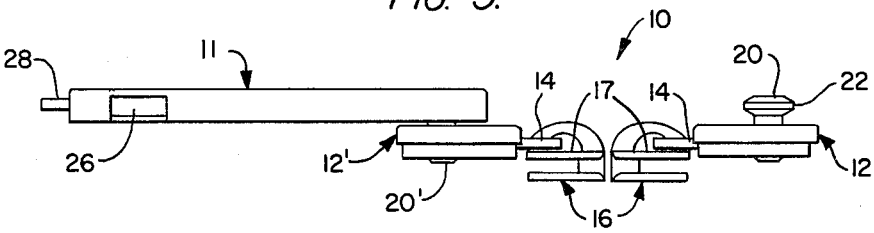
FIGS. 3 and 4 are side elevational views corresponding to FIGS. 1 and 2, respectively, these views omitting the zipper and the luggage case.
Figure 4:
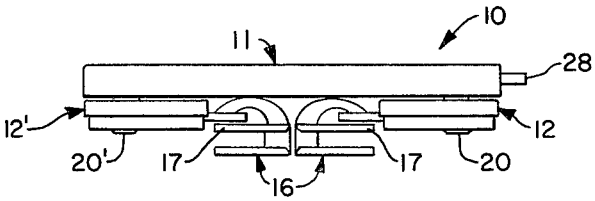

Preferably, the latch assembly is sized so that the sliders 16 must be in substantially abutting relationship with their respective pull tabs 14 lying adjacent to the top wing 17 of the sliders, as illustrated particularly in FIGS. 3, 4 and 6, for stud 20 to be received in opening 26. When latched, the latching device 10 fastens the sliders in abutting relationship (FIGS. 4 and 6) and the latch assembly 11 covers the sliders. Thus, there is no gap in the zipper and no visible opening between the sliders. Moreover, as will become apparent, the construction of the latching device is such that it may be conveniently operated with one hand. These are significant advantages of the invention.

Figure 2:
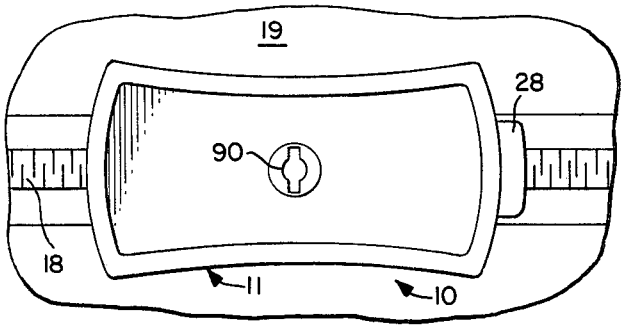
Figure 5:
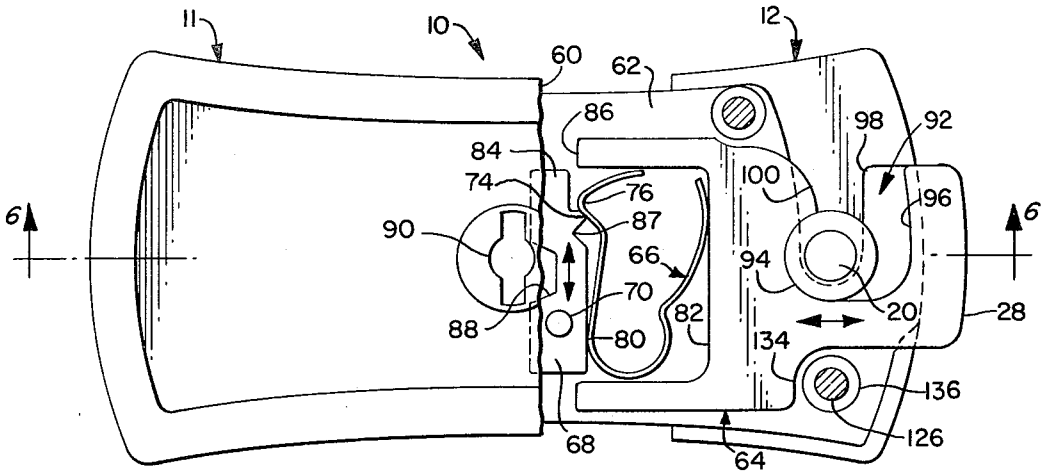
FIG. 5 is a top plan view, partially broken away, illustrating certain features of the latching device, this view showing the latching device in the closed position.
Figure 7:
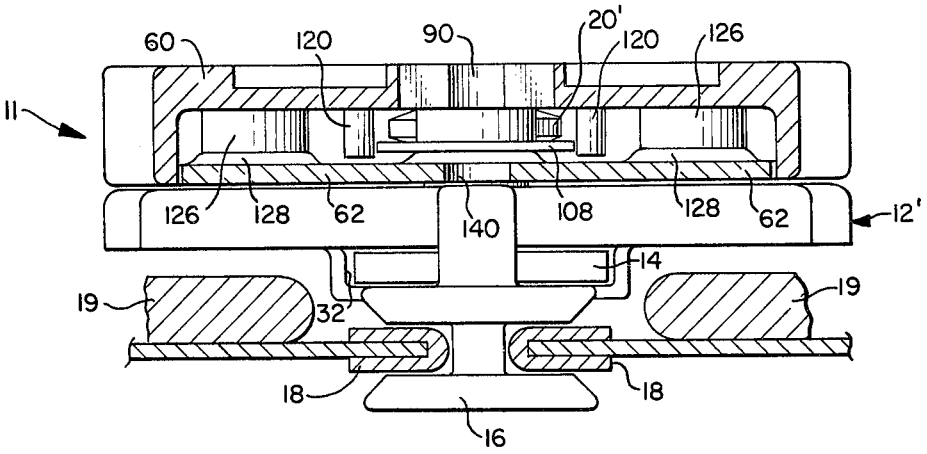
FIG. 7 is a cross sectional view taken approximately in the direction of line 7—7 of FIG. 6, this view showing the zipper and a portion of the luggage case.

As best illustrated in FIGS. 1–4, the latch assembly 11 preferably has an elongated shape and a relatively narrow thickness, so that the latching device 10 has a low profile, being substantially flush with the sliders (FIGS. 3 and 4). This substantially minimizes the possibility that the latching device can be damaged or torn off during use. Furthermore, the shape and low profile of the latching device imparts to it an aesthetically pleasing appearance. As best shown in FIGS. 1, 5 and 7, the width and shape of the tab assemblies are the same as the width and shape of the end portions of the latch assembly. Having the width of tab assembly 12 at least as wide as the end portion of the latch assembly facilitates holding the tab assembly steady as the latch assembly is brought into latching engagement with stud 20.

The tab assemblies, one (12) of which is illustrated in more detail in FIG. 8, will now be described. As previously indicated, the two tab assemblies are preferably identical. Accordingly, the description of tab assembly 12 will also suffice for the description of tab assembly 12'. Like elements of the two assemblies have been given the same numerical designators, except that the designators of tab assembly 12' are primed numbers to facilitate reference to an element of a particular assembly. It is to be understood, however, that the two assemblies may be readily interchanged. This minimizes the number of different parts required and reduces costs.

Figure 8:
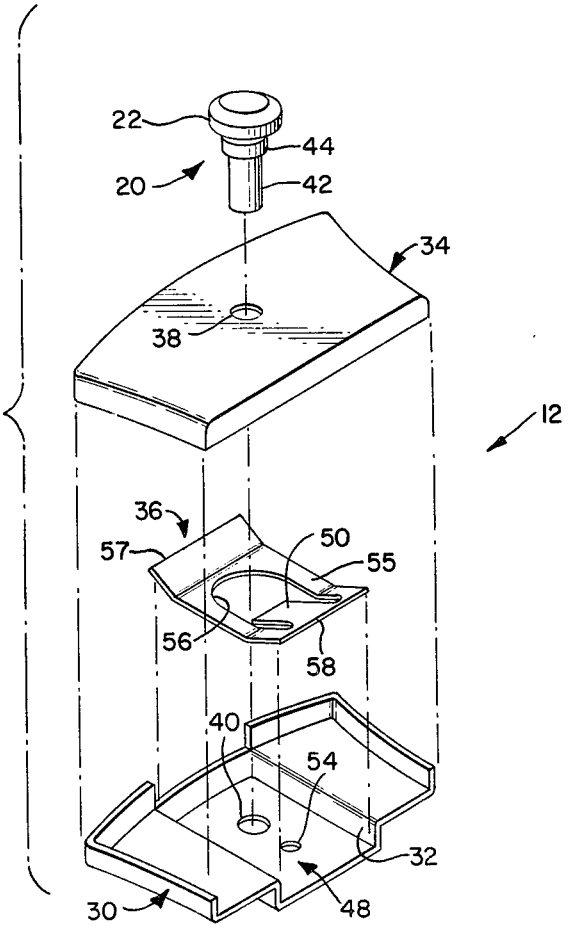
FIGS. 8 and 9 are exploded perspective views illustrating, respectively, a tab assembly and a latch assembly of the latching device.

As shown in FIG. 8, tab assembly 12 comprises a frame 30 with a U-shaped channel 32 therein, a cover plate 34 and a tab spring 36, in addition to stud 20. The frame and cover plate of the tab assembly may be held together by the stud. For this purpose, aligned holes 38, 40 in the frame and cover plate, respectively, are sized to pass shaft 42 of the stud. The stud is formed with a shoulder 44 adjacent to head 22, the shoulder having a larger diameter than hole 38, so that it rests on the cover plate when the stud is in place (FIG. 6). The opposite end of the stud which passes through hole 40 in the frame may be swedged or curled 46 (FIG. 6) to hold the frame and cover plate together. Shoulder 44 spaces head 22 of the stud above the cover plate, as shown, for receiving the latch assembly, in a manner which will be described hereinafter.

The tab assembly is formed to attach to the standard pull tab 14 of a conventional slider 16. The U-shaped channel 32 in the frame furnishes an opening 48 for receiving the pull tab of the slider. As illustrated in FIG. 6, tab spring 36 has an arm 50 which contacts the bottom of channel 32 in the frame when the spring is positioned within the tab assembly. Arm 50 is sized to pass through a hole 52 (normally semicircular) which is conventionally formed in the end of a slider pull tab. As the pull tab is inserted into opening 48, its end contacts arm 50 to lift it against the bias of the spring. When the pull tab has been inserted sufficiently to position hole 52 beneath arm 50, arm 50 passes through hole 52 to reengage the bottom of the U-shaped channel, as illustrated in FIG. 6, to restrain the pull tab within the tab assembly.

Tab spring 36 is preferably formed from flat spring steel or other suitable resilient material and shaped as illustrated in FIGS. 6 and 8. As shown, the tab spring generally includes a central portion 55 having an opening 56 therethrough for the shaft 42 of the stud. The opposite sides 57, 58 of the spring are bent upwardly from the central portion as shown, arm 50 being an extended portion of side 58. As illustrated in FIG. 6, cover plate 34 has an inverted U-shape in cross section. When assembled within the tab assembly, sides 57 and 58 of the tab spring are positioned adjacent to the underside 61 and the interior side walls 63 of the cover plate, with arm 50 in contact with the bottom of channel 32 in the frame. Contact between the tab spring and these surfaces holds the tab spring in the proper position within the tab assembly. After a pull tab 14 is inserted into the tab assembly, as previously described, forces tending to pull the pull tab out of the tab assembly cause side 58 to contact a side wall 63, and also cause central portion 55 to engage stud shaft 42, thereby restraining the pull tab within the tab assembly.

As can be appreciated, the construction of the tab assembly permits it to be quickly and easily attached to the pull tab of the slider. No extra parts are required for attachment. It is simply necessary to insert the pull tab into opening 48 until arm 50 snaps into place to engage the pull tab. A small hole 54 may be located in the frame (FIG. 8) so that a pin may be inserted through the bottom of the frame to release arm 50 from engagement with the pull tab and to allow the tab assembly to be removed from the slider. This facilitates removal of the tab assembly in the event of a malfunction of the device. This ease of removal of the tab assembly is another significant advantage of the invention.

Figure 9:
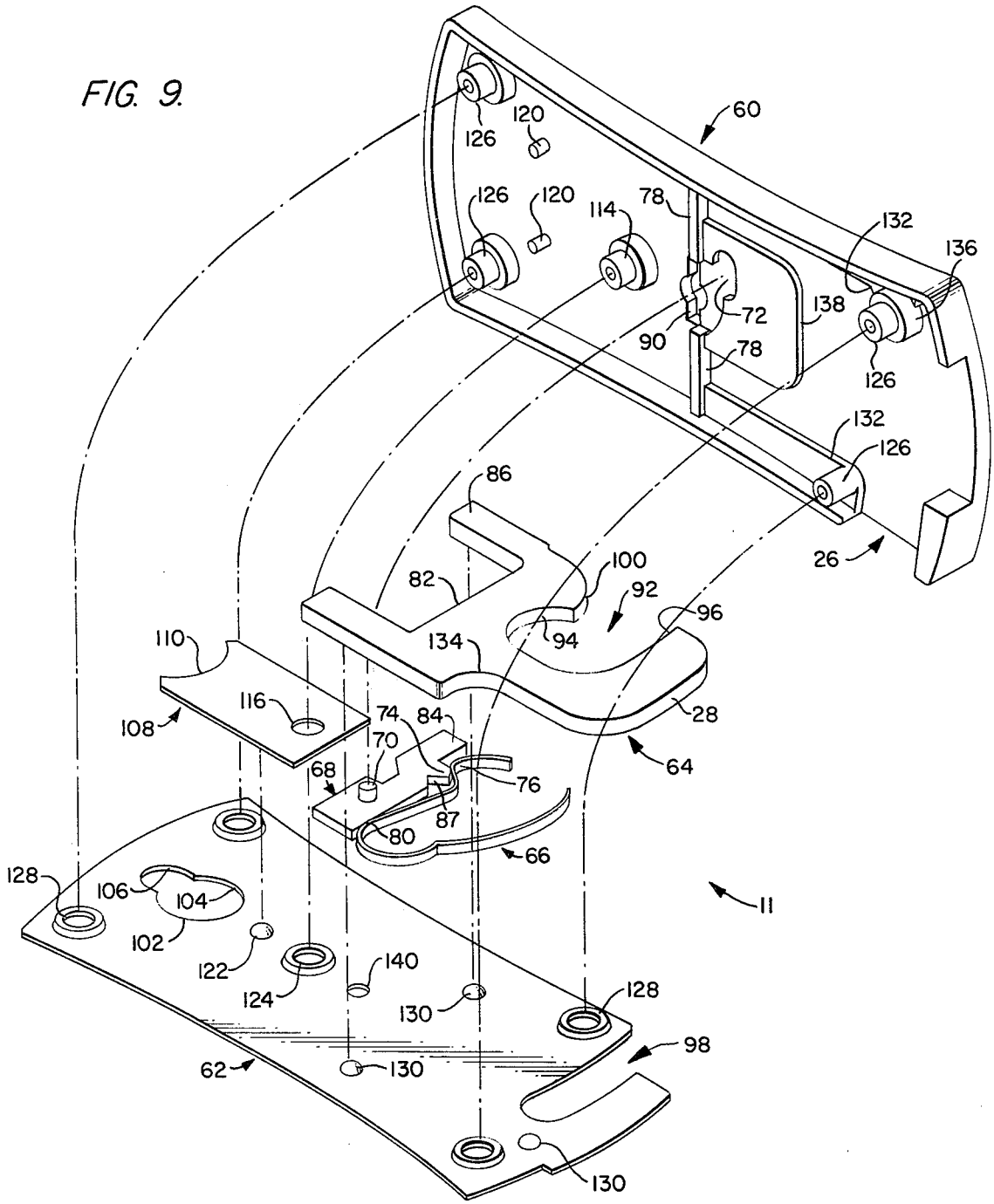

Turning now to a description of the latch assembly 11, a preferred form of the latch assembly is best illustrated in FIGS. 5 and 9. As shown, the latch assembly preferably includes a latch cover 60 mounted on a base plate 62 to form an enclosed case. Within the latch assembly is a latch member 64 formed for latching engagement with stud 20 of tab assembly 12 and a sliding bolt 68 for locking the latch member in a latched position.

Latch member 64 comprises a planar member slideably disposed within the latch assembly. One end of the latch member projects longitudinally from the latch assembly, as best illustrated in FIGS. 5 and 6, to form the release button 28. The opposite end of the latch member is U-shaped for receiving a spring 66 which urges end 28 of the latch member out of the latch assembly. Spring 66 also cooperates with bolt 68 in the following manner to provide a locking mechanism.

Bolt 68 is slideably disposed within the latch assembly adjacent to the U-shaped end of the latch member. When in a locked position, bolt 68 prevents operation of push button 28 to move latch member 64 to an unlatched position. As shown in FIGS. 5 and 9, a projection 70 on the bolt mates with a slotted recess 72 in the underside of the latch cover to guide the bolt movement transversely to the longitudinal dimension of the latch assembly. A second projection 74 formed along one side of the bolt contacts a curved portion 76 of the spring 66. The other side of the bolt slides along a ridge 78 formed in the latch cover. Spring 66 further contacts the side of the bolt at a point 80 adjacent to projection 70 so that the spring is compressed between the bolt and surface 82 of the latch member 64 between the legs of the U-shaped portion.

When the bolt is slid to locked position (in an upward direction as viewed in FIG. 5), end 84 of the bolt slides into position to contact end 86 of one of the U-shaped arms of the latch member. This prevents the latch member from being pushed into the case by the operation of push button 28, and thus prevents disengagement of the latch member from stud 20. When the bolt is in the locked position, a notch portion 87 in the side of the bolt adjacent to projection 74 is engaged by the curved portion 76 of the spring to prevent the bolt from sliding back to the unlocked position. A second notch 88, on the opposite side of the bolt from notch 87, is disposed adjacent to a key hole 90 in the latch cover and is cooperable with a key, not illustrated, inserted into the key hole for moving the bolt between a locked position and an unlocked position.

To receive stud 20 and hold the latch assembly in latching engagement therewith, latch member 64 has a cutout 92, shaped as illustrated, adjacent to opening 26. The cutout includes an arcuate portion 94 having a diameter slightly larger than the diameter of the stud head 22 and a somewhat larger portion 92 which allows the stud head to be received in the cutout. The arcuate portion 92 engages stud head 22 and prevents the latch assembly from rotating about its pivot on stud 20' to open the latch. Arcuate portion 94 of the cutout is held in latching engagement with the stud by the action of spring 66 urging the latch member to the right as viewed in FIG. 5. A slot 98 having a width slightly larger than the diameter of shoulder 44 of stud 20 is formed in the base plate 62 adjacent to cutout 92 and opening 26. Slot 98 guides stud 20 into the proper position within the latch assembly to be engaged by arcuate portion 94. The width of the slot closely confines the stud and prevents the sliders from separating, which would cause the stud head and the latch member to disengage and unlatch the device. As illustrated in FIG. 6, preferably the top of the stud abuts the underside of the cover plate 60, while base 62 is adjacent to cover plate 34 of tab assembly 12, when the device is latched. This limits the veritcal movement of the stud within the latch assembly and results in more secure latching.

To facilitate engagement between the latch member and the stud head, the edge of the latch member adjacent to opening 26 in the latch assembly may be curved to provide a cam 100 (FIGS. 5 and 9) which contacts stud head 22 as it moves into the cutout 92. This forces the latch member toward the left, as viewed in FIG. 5, allowing the stud to be inserted into slot 98 in the base plate. When the stud has been inserted sufficiently so that the stud head is in proper relationship for engagement with the arcuate portion 94, spring 66 forces the latch member to the right as viewed in FIG. 5, so that it engages the stud head to fasten the latch assembly 11 to the tab assembly 12. When the release button 28 of the latch member is depressed, the latch member is forced into the latch assembly, disengaging from the stud and allowing the latch assembly to be rotated to open the latch. This operation may be performed with one hand, which is a significant advantage of the invention.

To pivotally mount the latch assembly on stud 20' of tab assembly 12', the base plate 62 preferably has an elongated hole 102 adjacent to its end opposite slot 98 (FIG. 9). The elongated hole comprises partially merged holes having two different diameters. The larger diameter hole 104, is sized to pass the head of the stud. The smaller diameter hole 106 has a diameter which is slightly larger than the shoulder 44' of the stud but less than the diameter of the stud head 22'. This permits the stud head to be inserted through hole 104 in the base plate and the base plate positioned so that shoulder 44' enters hole 106. A latch spring 108, having an arcuate end portion 110 of a slightly larger diameter than that of stud head 22', is positioned within the latch assembly to be in abutting relationship with the stud head when shoulder 44' is received in hole 106. In mounting the latch assembly on the stud, as the stud head passes through hole 104, spring 108 is forced upwardly, as viewed in FIG. 6, allowing the stud head to enter the latch assembly. When the latch assembly is moved to position shoulder 44' in hole 106, the spring returns to the position illustrated in FIG. 6. The end portion 110 and the stud head form a block point 112 (FIG. 6) which retains shoulder 44' in hole 106. Preferably, stud 20' is sized such that its top abuts the underside of cover plate 60 of the latch assembly to provide a bearing surface for the latch assembly.

An advantage of mounting the latch assembly on the stud in this manner is that it can be removed easily. This is accomplished by unlatching the latching device 10 and by rotating the latch assembly 11 to a position such as illustrated in FIG. 3 in which access is provided to the bottom of the latch assembly. A pin or other implement can then be inserted through hole 104 to move latch spring 108 out of blocking relationship with the stud head. The latch assembly may then be moved so that the stud head can be positioned above hole 104 and the latch assembly can be removed from the tab assembly. A chamfer 118 on the head of the stud acts as a cam to force spring 108 upwardly as the latch assembly is moved, to facilitate positioning of the stud head above head 104.

As shown in FIGS. 6 and 9, the latch spring 108 may be mounted within the latch assembly 11 on a central shank 114 formed on the underside of the latch cover 60. Central shank 114 passes through a hole 116 in the end of the spring opposite to the arcuate portion 110. A pair of lugs 120, formed on the underside of the latch cover adjacent to opposite sides of spring 108, prevent rotary movement of the latch spring about central shank 114 and hold the latch spring in the proper blocking relationship with the stud head. A small knob or protrusion 122 in the base plate 62 is disposed between the elongated hole 102 and a receptor hole 124 for the central shank 114, to support the latch spring, as illustrated in FIG. 6, when it is in its blocking position.

To assemble the latch assembly, the latch spring 108 may be positioned on central shank 114 between lugs 120, the latch member 64, bolt 68 and spring 66 positioned in their proper relationships on the latch cover 60, and the base plate 62 attached to the latch cover by a plurality of shanks 126, formed on the underside of the latch assembly which extend through aligned receptor holes 128 in the base plate. The ends of the shanks may be swedged or cured to secure the base plate to the latch cover. Preferably, receptor holes 124, 128 are raised as illustrated in FIGS. 6, 7 and 9, so that the curled end portions of the shanks will be flush with the bottom of the base plate. Also included on the base plate may be a plurality or protrusions or knobs 130 which space the latch member from the surface of the base plate to reduce friction and permit smoother movement of the latch member (FIG. 9).

On the underside of the latch cover, longitudinal ridges 132, parallel to the sides of the U-shaped portion of the latch member, serve as guides to restrict the movement of the latch member to a longitudinal direction. An abutment surface 134 of the latch member opposite cutout 92 contacts shoulder 136 of one of the shanks 126 to limit the outward movement (to the right in FIG. 5) of the latch member when it is disengaged from the stud. A plate 138 formed on the underside of the latch cover prevents vertical movement of spring 66 and retains the spring within the U-shaped cutout portion of the latch member. A key tip hole 140 adapted to receive the tip of a key inserted into key hole 90 may also be provided in the base plate.

Except for springs 36, 66 and 108, which are preferably formed from resilient material such as spring steel, as previously indicated, and the latch assembly cover which may be die cast in a well-known manner, the remaining components are preferably formed of hard steel or other suitable material.

While the foregoing description has been with reference to a particular illustrated embodiment, it will be appreciated that numerous variations are possible without departing from the principles and the spirit of the invention, the scope of which is defined by the appended claims. For example, the latching device may also be employed with a single-slider zipper to fasten the slider in abutting engagement with a zipper end stop. In this case, the end stop may be formed with a projecting stud such as studs 20, 20′, and the latch assembly may be pivoted either on the stud of the tab assembly or on the stud of the end stop.

What is claimed is:

1. A latching device for a double-slider zipper arrangement comprising first and second tab assemblies, each tab assembly having an opening for receiving a pull tab pivotally connected to one of the zipper sliders and having means therein for engaging the pull tab to attach the tab assembly to the pull tab, and a latch assembly mounted on the first tab assembly, the latch assembly having means for latching engagement with the second tab assembly to latch the zipper sliders together.

2. The device of claim 1, wherein the means for engaging the pull tab comprises spring means adapted to enter a hole in the pull tab when the pull tab is inserted into the tab assembly.

3. The device of claim 2, wherein each tab assembly further comprises means for permitting release of the engagement between the spring means and the pull tab to permit the pull tab to be removed.

4. The device of claim 1, wherein the latch assembly is pivotally mounted on the first tab assembly for rotation in a plane parallel to the plane of the pull tab to which the first tab assembly is attached.

5. The device of claim 4, wherein the first tab assembly comprises a projecting stud, the latch assembly being pivotally mounted on the projecting stud.

6. The device of claim 5, wherein the latch assembly comprises a base having an aperture therein adapted for receiving the stud of the first tab assembly, and retaining means engageable with the stud for retaining the stud within the latch assembly.

7. The device of claim 6, wherein the stud includes a head portion and a shoulder portion, the head portion having a diameter greater than the diameter of the shoulder portion and being spaced from the first tab assembly by the shoulder portion, and said aperture includes an elongated hole comprising partially merged first and second holes, the first hole being sized to pass the head of the stud and the second hole having a diameter slightly greater than the diameter of the shoulder portion, and wherein the retaining means retains the shoulder portion of the stud in the second hole.

8. The device of claim 7, wherein the retaining means includes a spring member, the spring member having an arcuate end portion in engaging relationship with the head of the stud when the shoulder portion is in the second hole.

9. The device of claim 8, wherein the spring member is positioned with respect to said first hole such that said end portion may be moved out of said engaging relationship with the stud head by means insertable through said first hole to permit removal of the latch assembly from the stud.

10. The device of claim 1, wherein the second tab assembly has a projecting stud with a head and the latch assembly is formed to receive the head of the stud.

11. The device of claim 10, wherein the latching means includes a latch member slideably disposed within the latch assembly, the latch member having a portion formed for latching engagement with the stud.

12. The device of claim 11 wherein the stud comprises a shoulder and wherein the latch assembly further comprises a cover positioned on a base, the base having a slot therein with a width sized to admit the shoulder and the cover having an opening aligned with said slot for receiving said stud, and wherein said portion of the latch member comprises a cutout having an arcuate portion formed for latching engagement with the head of said stud.

13. The device of claim 12, wherein the latch member further includes a cam portion adjacent to the opening in the cover and the cutout, the cam portion engageable with the stud received in the opening to move the latch member toward a non-latching position to permit the stud to be positioned in the arcuate portion of the cutout.

14. The device of claim 13, wherein the latch member has a U-shaped portion and the latch assembly includes spring means disposed within the U-shaped portion for biasing the latch member toward latching position.

15. The device of claim 14, wherein the latch member includes a portion projecting from the latch assembly, the projecting portion manually operable to move the latch member against the bias of the spring means to said non-latching position, in which the latch member is disengaged from the stud received in the opening.

16. The device of claim 14, wherein the latch assembly further comprises a bolt slideably disposed for movement to a locking position in which the bolt is engageable with the latch member to lock the latch member in the latching position, and wherein the spring means engages the bolt and is cooperable therewith to hold the bolt alternately in said locking position and a non-locking position.

17. The device of claim 1, wherein the tab assemblies and the latch assembly are shaped to have a low profile such that the latching device is substantially flush with the sliders, and wherein the tab assemblies and the latch assembly are sized such that the pull tabs are each adjacent to a top wing of their respective sliders when the latching device is in latched position.

18. The device of claim 1, wherein the latch assembly is sized to hold the sliders in substantially abutting relationship and to substantially cover the sliders.

19. A latching device for latching a zipper slider movable on a zipper to a member, the device comprising a case having an opening therein for receiving the end of a pull tab pivotally connected to the zipper slider, means for engaging the pull tab to attach the case thereto, and a latch assembly pivotally mounted on the case for movement in a plane parallel to the plane of the zipper, the latch assembly having means for latching engagement with cooperable means on the member to latch the zipper slider to the member.

20. A latching device for latching a zipper slider movable on a zipper to a member, the device comprising a tab assembly having an opening for receiving a pull tab pivotally connected to the zipper slider and having means therein for engaging the pull tab to attach the tab assembly thereto, the tab assembly and the member each having a projecting stud, and a latch assembly pivotally mounted on a first one of said studs for movement in a plane parallel to the plane of the zipper and having means for latching engagement with the second one of said studs.

21. An assembly for attachment to a pull tab pivotally connected to a zipper slider, the assembly comprising a base, a cover positioned on the base to form a case, the case having an opening therein for receiving an end of the pull tab, and a spring member disposed within the case, the spring member constructed to be lifted by the pull tab upon the pull tab being inserted into the opening and to snap into an aperture in the pull tab to attach the case thereto.

22. The assembly of claim 22, wherein the base has a channel communicating with the opening, the channel sized to receive the pull tab, and wherein the spring member has an arm biased into engagement with the channel, the arm adapted to be lifted by an end of the pull tab inserted into the case and sized to pass through said aperture in the pull tab.

23. The assembly of claim 21 comprising means for mounting a latch assembly on the case for latching the slider to another assembly, the mounting means comprising a stud passing through the cover and the base, the stud being constructed to connect the cover to the base to form said case.

* * * * *